US008679264B2

(12) United States Patent
Chaffotte et al.

(10) Patent No.: US 8,679,264 B2
(45) Date of Patent: Mar. 25, 2014

(54) METHOD FOR PRODUCING A GASEOUS ATMOSPHERE FOR TREATING METALS

(75) Inventors: Florent Chaffotte, Bagneux (FR); Didier Domergue, Palaiseau (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 224 days.

(21) Appl. No.: 13/133,538

(22) PCT Filed: Nov. 25, 2009

(86) PCT No.: PCT/FR2009/052290

§ 371 (c)(1),
(2), (4) Date: Jun. 8, 2011

(87) PCT Pub. No.: WO2010/066979

PCT Pub. Date: Jun. 17, 2010

(65) Prior Publication Data

US 2011/0272637 A1 Nov. 10, 2011

(30) Foreign Application Priority Data

Dec. 9, 2008 (FR) ..... 08 58379

(51) Int. Cl.
*C23C 8/06* (2006.01)
*C23C 8/20* (2006.01)

(52) U.S. Cl.
USPC ..... 148/206; 148/235

(58) Field of Classification Search
USPC ..... 148/235, 206
See application file for complete search history.

(56) References Cited

U.S. PATENT DOCUMENTS

| | | | | | |
|---|---|---|---|---|---|
| 4,306,919 | A | * | 12/1981 | Roberge et al. | 148/235 |
| 5,298,089 | A | * | 3/1994 | Bowe et al. | 148/208 |
| 5,591,274 | A | * | 1/1997 | Takahashi | 148/206 |

FOREIGN PATENT DOCUMENTS

| | | |
|---|---|---|
| EP | 0 953 654 | 11/1999 |
| FR | 2 712 898 | 6/1995 |
| GB | 2 037 816 | 7/1980 |

OTHER PUBLICATIONS

International Search Report for PCT/FR2009/052290, mailed Apr. 9, 2010.
Schmidt, Michael L., "Preoxidation Prior to Gas Carburizing: Theory and Its Effect on Pyrowear 53 Alloy," J. Heat Treating, Springer-Verlag New York Inc., vol. 8, No. 1, 1990, pp. 5-19.
PCT/FR2009/052290 Written Opinion dated Apr. 9, 2010.

* cited by examiner

*Primary Examiner* — Wayne Langel
(74) *Attorney, Agent, or Firm* — Elwood L. Haynes

(57) ABSTRACT

The invention relates to a method for generating an atmosphere for heat treating metal parts in a furnace, which includes inserting, in at least one phase of the treatment cycle or at least one area of the heat treatment furnace, a mixture comprising gaseous $CO_2$ and ethanol in the form of fine droplets or vapor, so as to carry out the reaction between the $CO_2$ and the ethanol inside the furnace to form a mixture of hydrogen and CO according to the reaction: $CO_2 + C_2H_5OH \rightarrow 3\ CO + 3\ H_2$, characterized in that the injection is performed in a phase of the treatment cycle or in an area of the heat treatment furnace in which the temperature is higher than 750° C., while $CO_2$ alone or optionally mixed with nitrogen is injected in the phase or phases of the treatment cycle or in the area or areas of the furnace in which the temperature is lower than 750° C.

4 Claims, No Drawings

METHOD FOR PRODUCING A GASEOUS ATMOSPHERE FOR TREATING METALS

The present invention relates to the field of heat treatments of metal parts.

One of the objectives of the present invention is to propose a novel process for supplying an atmosphere to be injected into furnaces intended for the heat treatment or thermochemical treatment of metal parts.

The atmospheres targeted by the present invention must make it possible, on the one hand, to avoid decarburization and oxidation of the parts, but, on the other hand, to be capable of enriching the parts with carbon (carburization and carbonitridation processes). Finally, this atmosphere must be able to be produced under economical and safe conditions, and be easy to handle.

The heat treatment atmospheres corresponding to the above criteria generally contain, as majority components, nitrogen which has a neutral role with respect to the treatments targeted above, hydrogen which protects against oxidation, and carbon monoxide which both protects against oxidation and decarburization and if necessary makes it possible to carry out an enrichment in carbon (carburization). Minority components such as $CO_2$ and water or else $CH_4$ are also found in these atmospheres. The atmosphere may also be enriched in hydrocarbons (natural gas, propane, etc.) in order to have an influence on the chemical equilibria.

Among the methods conventionally used at present for producing such atmospheres, mention may be made of the methods listed below, which are well known to a person skilled in the art.

Firstly, these atmospheres may be produced by what are known as "endothermic generators". These generators produce the atmosphere from a reaction between air and a fuel (generally natural gas), a reaction that takes place in a catalytic reactor heated to a temperature of the order of 1000° C. This type of atmosphere typically contains, as majority components, 40% nitrogen ($N_2$), 40% hydrogen ($H_2$) and 20% carbon monoxide (CO). The atmospheres produced by an endothermic generator have been known and used for many years, but have the drawback of necessitating, for the user, the investment of a dedicated production machine. Furthermore, the use of an endothermic generator often proves to be rather inflexible. The production capacity is generally difficult to adapt to the actual requirement and it is then necessary to permanently produce a flow rate higher than the flow rate needed. Moreover, the contents of the various constituents of the mixture are fixed by the reaction that takes place in the catalytic reactor: although it remains possible to decrease the contents of $H_2$ and CO by dilution with nitrogen (a process commonly referred to as "dilute endo"), it is not, on the other hand, industrially feasible to increase the contents of CO and $H_2$ beyond 20% and 40% respectively. Indeed, in order to increase the majority contents it is necessary to increase the oxygen content at the expense of the nitrogen, which poses problems of safety and of resistance of the materials.

Another well-known manufacturing method is described as "in situ", or "synthesis atmosphere", by the fact that the atmosphere is obtained without the intervention of an external generator, but by directly injecting a mixture of the various gaseous constituents needed into the furnace, these constituents reacting together in situ, in a zone of the furnace that is suitable in terms of temperature. Among these atmospheres, mixtures of nitrogen and of methanol are especially found.

Methanol is usually injected, with the aid of a pipe inserted into the heat-treating furnace, via a capillary tube using an annular flow of gaseous nitrogen which sprays the methanol in the form of fine droplets in order to carry it into the furnace. Under the effect of the temperature of the furnace, which may rise typically to 900° C., the molecule of methanol cracks to form CO and $H_2$, according to the following reaction:

$$CH_3OH \rightarrow CO + 2H_2.$$

The mixture formed thus contains two times more hydrogen than CO.

The atmospheres formed from nitrogen and methanol therefore make it possible, in particular, to synthesize an atmosphere identical to that produced by an endothermic generator. It is also possible, depending on the ratio of nitrogen and methanol, to obtain an atmosphere that is richer in $H_2$ and CO. These atmospheres will make it possible, in particular, to carry out the carburization treatments more rapidly. The main drawbacks of this solution are on the one hand its cost, which is mainly linked to the methanol prices and on the other hand the toxicity of the latter, but furthermore regarding the fact that this process today proves limited in terms of treatment rapidity relative to technological breakthrough processes such as low-pressure carburization. Furthermore, the cracking reaction of methanol is highly endothermic which results in significant energy consumption and the formation of cold zones in the furnaces.

For the carburization and carbonitridation treatments carried out in a gaseous atmosphere of generator atmosphere or synthesis atmosphere type, the rapidity of the treatment is linked to the rate of transfer of carbon between the atmosphere and the surface of the parts or carbon flux $\Phi_C$, which may be expressed in the following manner:

$$\Phi_C = \beta(CP - C_S)$$

where $C_S$ represents the carbon content of the treated parts, CP represents the carbon potential of the atmosphere defined as the content of an iron shim exposed to the atmosphere for an infinite time, $\beta$ is the carbon transfer coefficient which is proportional to the product of the contents of CO and $H_2$.

The carbon potential may be calculated according to the following equation under the assumption of an atmosphere that is at equilibrium:

$$CP = \frac{100 \cdot CO^2 / CO_2}{19.6 \cdot CO^2 / CO_2 + 1.07 \cdot \exp(4798.6/T)}$$

The carbon potential is therefore characteristic of the equilibrium that may occur between the part and the atmosphere, and the coefficient $\beta$ characterizes the speed at which this equilibrium may be achieved.

When seeking to increase productivity, the advantage is therefore seen in increasing the contents of CO and $H_2$, in order to maximize the carbon flux through the carbon potential and the carbon transfer coefficient $\beta$.

An atmosphere containing 50% of CO and 50% of $H_2$ makes it possible in particular to maximize the carbon transfer coefficient $\beta$.

The present invention then proposes a novel process for producing an atmosphere of the type targeted above (that makes it possible to avoid decarburization and oxidation of the parts while being capable of enriching the parts in carbon), by directly injecting a mixture comprising carbon dioxide and ethanol, to which nitrogen is optionally added, into the furnace.

This mixture may optionally be enriched in additional species that make it possible to control the chemical equilibria in the atmosphere (hydrocarbons, air, etc.).

The atmosphere may optionally be enriched in ammonia for carbonitridation purposes.

One of the advantageous features of the invention lies however in the possibility of using only $CO_2$ and ethanol in order to control these chemical equilibria, where conventional generator or synthesis atmospheres require air and hydrocarbon additions. Depending on the $CO_2$/ethanol ratio, the residual $CO_2$ content will be higher or lower, which directly conditions the carbon potential of the atmosphere.

The components intended for the synthesis of the atmosphere may, for example, be injected using injection equipment already known for the implementation of nitrogen/methanol atmospheres.

It is possible, as is mostly commonly carried out, to inject the liquid phase (ethanol) through a capillary in a pipe comprising an annular flow composed of gaseous phases ($CO_2$, nitrogen) which will thus carry the ethanol and spray it into the furnace chamber.

The ethanol may also be vaporized upstream of the furnace injection in order to be injected in gaseous form as a mixture with the other gaseous species.

Finally, again by way of illustration, the ethanol may be introduced directly in the liquid phase into the furnace chamber (for example deposited in a cup) so that it is vaporized under the effect of the temperature of the furnace and can thus react with the gaseous species introduced separately into the furnace chamber.

Inside the furnace, the $CO_2$ reacts with the ethanol to form a mixture of hydrogen and CO according to the reaction:

$$CO_2+C_2H_5OH \rightarrow 3CO+3H_2.$$

But according to one preferred implementation of the invention, the injection is carried out during a phase of the treatment or in a zone of the furnace at a temperature greater than 750° C., and more preferably still for which the temperature is located within the interval ranging from 850° C. to 1000° C.

It will have been understood that it is possible to deal with continuous furnaces or batch furnaces, and therefore reference will be made in the following either to "zone of the furnace" or "phase of the treatment" where/during which the mixture comprising ethanol is injected (even a batch furnace may have several zones or chambers and all these chambers do not necessarily have the same atmosphere).

It is furthermore known that the safety constraints linked to the use of the heat-treating atmospheres that are described in the standard NF-EN 746-3 are very strict, and in particular make it obligatory not to inject any atmosphere considered to be inflammable (for example containing potentially more than 5% of the $H_2$, CO mixture) below 750° C. Consequently, below 750° C., the processes inject, in general, a "substitution" gas, generally nitrogen alone.

It may thus be said that in the case of nitrogen-methanol atmospheres, nitrogen plays the following roles:

- the role of "process gas" mixed with the gas derived from the cracking of methanol (the nitrogen plays the role of carrier gas "propelling" the methanol);
- the role of "safety gas" (100% flow rate) in the following cases:
  - when the temperature is less than 750° C.;
  - for detecting a drop in flow rate or pressure of nitrogen.

It is then proposed, according to a preferred implementation of the present invention, to inject the mixture comprising ethanol above 750° C. and to inject, below 750° C., $CO_2$ alone or optionally mixed with nitrogen, which furthermore has the advantage of carrying out a preoxidation of the feedstock, which will accelerate the treatment by burning the organic materials (grease, cutting oil, etc.) and by activating the surface in view of the treatment in the following phase of the cycle.

The process according to the invention has many advantages over the existing processes, among which, mention may be made of the following aspects:

- in the case of using mixtures of $CO_2$ and ethanol without nitrogen, an $H_2$/CO mixture is obtained that contains 50% of each constituent. This mixture is known for giving a treatment efficiency and rapidity that are optimal for carburization (excluding low-pressure carburization). Compared to conventional endothermic generator or nitrogen-methanol atmospheres, a gain in productivity is thus obtained which may range up to 30%;
- furthermore, ethanol has a cost relatively similar to that of methanol, while giving rise to the formation of a larger volume of atmosphere. Specifically, 1 liter of methanol gives rise to the formation of 1.67 $Nm^3$ of cracked gas ($H_2$+CO), whereas the same amount of ethanol gives rise to the formation of 1.95 $Nm^3$ of atmosphere;
- ethanol is a non-toxic product unlike methanol;
- it is available both from sources of production based on fossil energies or based on agriculture products, whereas methanol results exclusively from production processes based on petroleum products;
- the process according to the invention is easily adapted to the furnaces presently fed by conventional mixtures of nitrogen and methanol, specifically it makes it possible to use, as is, the set of existing nitrogen and methanol injection circuits;
- if necessary, the $H_2$/CO mixture thus generated may be diluted with nitrogen so as to adjust, in a very flexible manner, the composition and therefore the activity of the atmosphere;
- it enables the preoxidation of the feedstocks without the need to provide a specific furnace for this operation.

The present invention then relates to a process for generating an atmosphere intended for the heat treatment of metal parts in a furnace, according to which a mixture comprising gaseous $CO_2$ and ethanol in the form of fine droplets or vapor is introduced into at least one phase of the treatment cycle or at least one zone of the heat-treating furnace so as to carry out, inside the furnace, the reaction between the $CO_2$ and the ethanol in order to form a mixture of hydrogen and of CO according to the reaction:

$$CO_2+C_2H_5OH \rightarrow 3CO+3H_2$$

and being characterized in that the injection is carried out in a phase of the treatment cycle or a zone of the heat-treating furnace for which the temperature is greater than 750° C., and more preferably still is located within the interval ranging from 850° C. to 1000° C., while $CO_2$ alone or optionally mixed with nitrogen is injected into the phase or phases of the treatment cycle or the zone or zones of the furnace for which the temperature is less than 750° C.

The present invention may furthermore adopt one or more of the following technical features:

- the mixture injected also comprises gaseous nitrogen,
- the ethanol is heated and/or vaporized before injection into the furnace.

What is claimed is:

1. A process for generating an atmosphere for the heat treatment of metal parts in a furnace, the process comprising the steps of a) introducing a first mixture into at least one phase of a heat treatment cycle or at least one zone of the heat-treating furnace, the mixture comprising i) gaseous $CO_2$ and ii) ethanol in the form of fine droplets or vapor, to thereby form a second mixture of hydrogen and of CO according to the reaction:

$$CO_2+C_2H_5OH \rightarrow 3CO+3H_2$$

wherein a temperature of the at least one phase of a heat treatment cycle or at least one zone of the heat-treating furnace is greater than 750° C., and b) introducing a third inflammable mixture comprising gaseous $CO_2$ alone or mixed with nitrogen into at least one phase of the heat treatment cycle or at least one zone of the heat-treating furnace wherein a temperature is less than 750° C.

2. The process of claim 1, wherein the temperature of step a) is from 850° C. to 1000° C.

3. The process of claim 1, wherein the first mixture further comprises gaseous nitrogen.

4. The process of claim 1, further comprising the step of heating and/or vaporizing the ethanol before step a).

* * * * *